US005990455A

United States Patent [19]

Scott et al.

[11] Patent Number: 5,990,455

[45] Date of Patent: Nov. 23, 1999

[54] CHAFING DISH

[75] Inventors: Chester B. Scott, Lexington, S.C.; Chester Scott, III, Mentor, Ohio

[73] Assignee: Chesterfield Products, Inc., Mentor, Ohio

[21] Appl. No.: 09/065,162

[22] Filed: Apr. 23, 1998

[51] Int. Cl.[6] ..... H05B 3/78

[52] U.S. Cl. ..... 219/430; 219/432; 219/437; 392/448; 392/501

[58] Field of Search ..... 219/430, 429, 219/432, 437; 126/33, 377, 378; 99/403, 483; 392/448, 497, 498, 501

[56] References Cited

U.S. PATENT DOCUMENTS

| | | | |
|---|---|---|---|
| 1,697,732 | 1/1929 | Newland | 392/497 |
| 1,994,909 | 3/1935 | Ehrgott | 219/437 |
| 2,471,259 | 5/1949 | Chapman | 392/498 |
| 2,576,688 | 11/1951 | Landgraf | 392/498 |
| 2,756,425 | 7/1956 | Webber | 219/437 |
| 3,476,915 | 11/1969 | Rapsis | 392/448 |
| 3,797,563 | 3/1974 | Hoffmann et al. | 219/387 |
| 3,971,307 | 7/1976 | Graham | 99/403 |
| 5,045,672 | 9/1991 | Scott | 219/439 |

*Primary Examiner*—Joseph Pelham

*Attorney, Agent, or Firm*—Watts, Hoffman, Fisher & Heinke, Co., L.P.A.

[57] ABSTRACT

A heater for use with a chafing dish having water and food pans with complemental peripheral flanges is disclosed. The heater includes a spacer sized to be interposed between such flanges to maintain at least portions of the flanges in spaced relationship. An immersible heater assembly including an upstanding arm is connected to and depends from the spacer. The heater assembly includes an encased electrical resistance heater loop having end portions connected to the arm. The arm and loop are sized to position the loop near a bottom of the water pan and immersed in water when the chafing dish is in use. A temperature sensitive switch is connected to the heater unit for interrupting a power supply when the temperature of the heater unit exceeds a predetermined temperature. A power supply cord extends from the spacer outwardly from the dish when the heater is in use.

8 Claims, 1 Drawing Sheet

CHAFING DISH

This invention relates to chafing dishes and more specifically to a novel and improved electrical heater assembly for chafing dishes for producing desired water vapor conditions to maintain foods at temperatures appropriate for serving.

BACKGROUND OF THE INVENTION

Chafing dishes are widely used for buffet type food service, serving hors d'oeuvres, and other purposes. Such chafing dishes typically include a water pan supported by a leg and a bracing structure. A heat source is used to heat the water in the water pan. A food pan is supported by the water pan above the level of the water.

In most instances flames from canned fuels are used as the heat source. Other chafing dishes have been proposed which use electrical heaters rather than flames to heat the water. But, the known electrically heated chafing dishes also have drawbacks. Some prior electric heater elements project through holes in the water pan to provide terminals for connection to a power source. These holes obviously must be sealed and are themselves a source of service trouble.

Heater elements which are physically connected to the water pan with portions of the elements projecting through holes in the water pan, are difficult to clean. Since they are difficult to clean the elements tend to suffer from scale build-up which reduces efficiency and degrades the performance of the unit.

Other prior proposals placed electric heating elements beneath the water pan. These proposals required support structure adding significantly to complexity and cost.

With canned fuels, the fuel is either an alcohol base material or an oil and wick arrangement. The alcohol materials tend to vapor lock so that flame size varies and produces uneven heat. Diaphragms are sometimes provided that are adjustable to control the size of the flame and with it hopefully the amount of heat produced. The problem with these diaphragms is that with the tendency of the alcohol type fuel to vaporize, the flame is often extinguished.

With wick and oil heat sources, the only ability to control the temperature of the flame is by spreading of the wick to increase the size of the flame. Thus, at best there is very limited control of temperature using a flame arrangement.

Canned heat sources are costly and wasteful. Typically after a food service the cans which have been used will be disposed of and new cans will be used at a subsequent service to be sure that there is adequate fuel at the subsequent service. Moreover, cans of fuel typically must be bought in quantity which ties up both capital and storage space.

The chafing dish described and claimed in Pat. No. 5,045,672 issued Sep. 3, 1991 (the Prior Patent) was very favorably received in test installations, but it had one major drawback. Specifically, it was necessary to provide either specialized water or food pans notched to receive a heating element.

SUMMARY OF THE INVENTION

The present invention is an improvement over the chafing dish of the Prior Patent. More specifically, a rectangular spacer is interposed between flanges of water and food pans with the spacer surrounding the body of the food pan. In the preferred arrangement the flange is composed of four elongate linear elements joined by four corner elements with one of the corner elements being a heater support forming a part of a heater assembly. The assembly includes members which depend from the heater support including a tube mechanism encasing leads and a heater element. The heater element and a section of the tube mechanism are preferably in loop form for positioning near the bottom of a water pan. A temperature sensitive switch is encased within the tube mechanism and connected to the heater for interrupting a supply of electricity to the heater when an overheated condition exists such as when a water pan has gone dry.

Accordingly, the object of the invention is to provide a novel and improved electrically heated chafing dish.

DESCRIPTION OF THE PREFERRED EMBODIMENT

Figure 1:
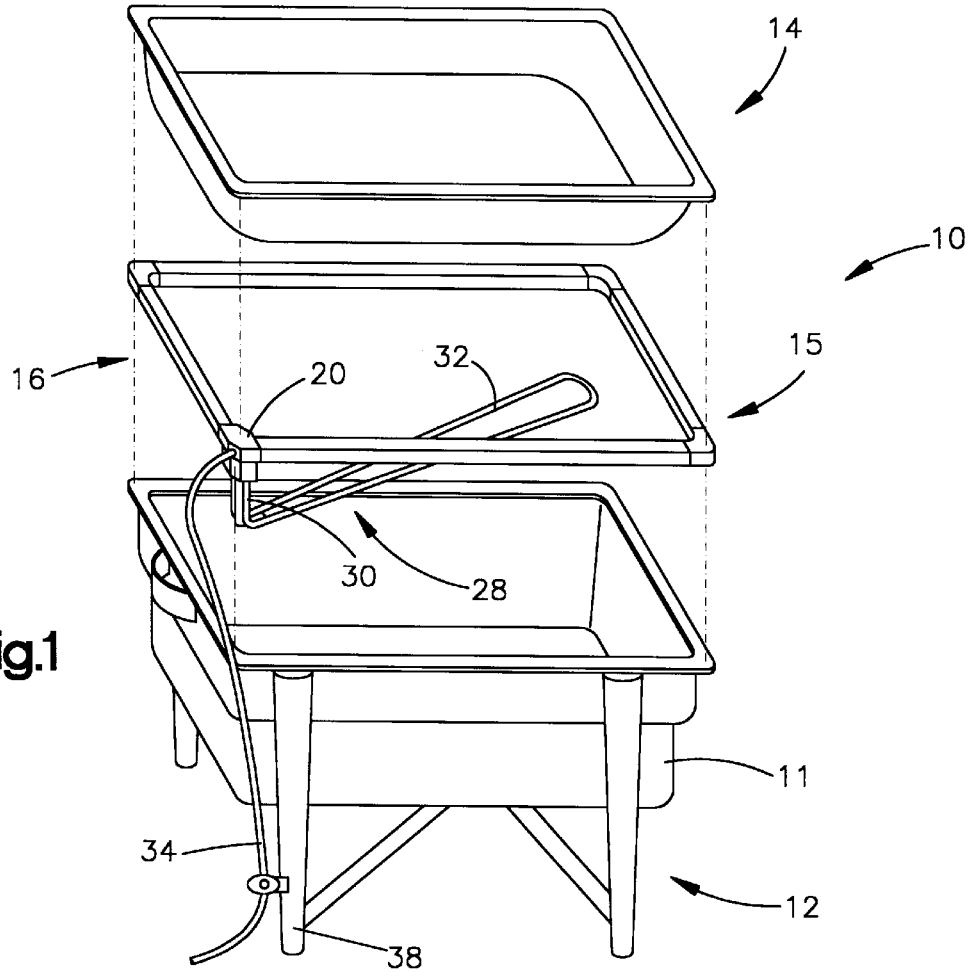
FIG. 1 is an exploded view of a chafing dish and the heater assembly of the present invention in its preferred form; and, FIG. 2 is a plan exploded view of the heater assembly.
Figure 2:
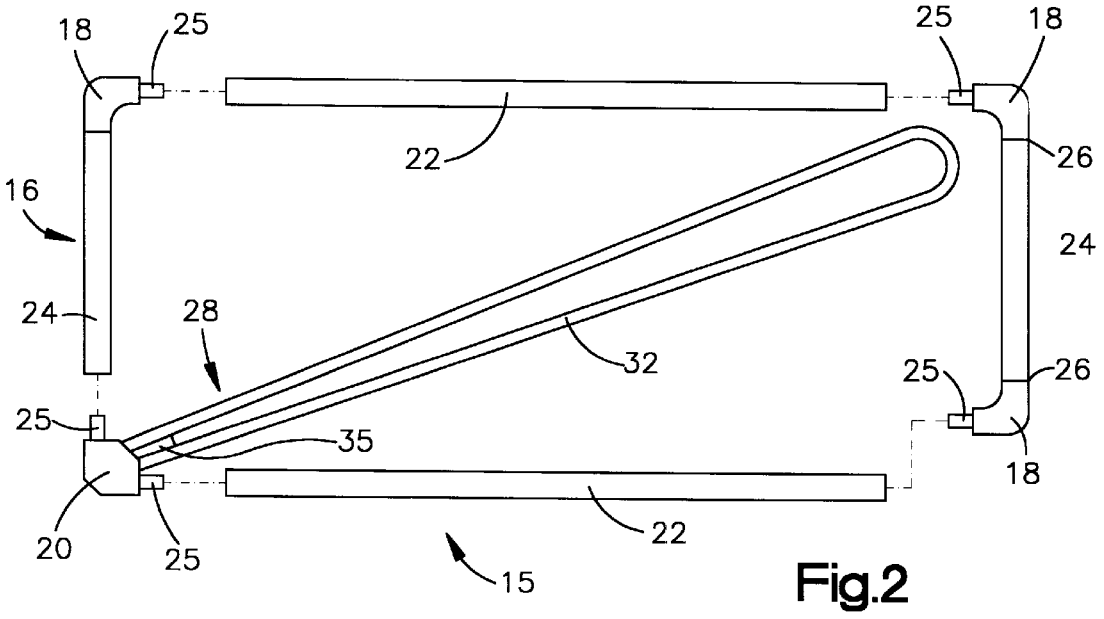

Referring now to the drawings and FIG. 1 in particular, the chafing dish of the present invention is shown generally at 10. The dish includes a water pan 11, support structure shown generally at 12 and a food pan 14. The water pan and support structure and the food pan 11,12,14 may be any of the many commercially available chafing dish pans and supports.

The heater structure of the present invention is shown generally at 15. The heater structure includes a spacer 16. The spacer 16 preferably includes three identical corner elements 18 and a heater support corner element 20. Elongate linear side and end elements 22,24 are joined together by the corner elements to form the spacer 16.

Each of the corner elements 18,20 includes projecting tabs 25 sized to project into end recesses, not shown, at the opposite ends of each of the side and end elements. The tabs 25 are preferably bonded to the side and end elements as by an adhesive. Shoulders of the corner elements abut ends of the side and end elements, as indicated at 26 to form the open rectangular spacer 16 as shown in FIG. 1. The spacer elements may be injection molded. To enable ready fabrication of spacers of a range of sizes adapted to fit any chafing dish, the end and side elements are alternately formed by cutting elements of appropriate lengths from tubular extrusions of rectangular external configuration.

A tube mechanism shown generally at 28 is provided. The tube mechanisms includes a depending section 30 and a loop section 32. The loop section encases a resistance heater element, not shown, while the depending section 30 houses leads connecting a power supply cord 34 to the heater element. The tube mechanism 28 includes a switch encasing section 35 housing a bimetallic switch, not shown. The switch is connected to the leads in series with the heater element. The switch is normally closed, but opens when an excessive heat condition is sensed to interrupt the supply of current to the heater element, such as when the water pan 12 has run dry.

A clip 36 removably fastens the supply cord 34 to a leg 38 of the dish support structure 12 to protect against the cord 34 being pulled from the heater support corner element 20.

Although the invention has been described in its preferred form with a certain degree of particularity, it is understood that the present disclosure of the preferred form has been made only by way of example and that numerous changes in the details of construction, operation and the combination and arrangement of parts may be resorted to without departing from the spirit and the scope of the invention as hereinafter claimed.

What is claimed is:

1. For use with a chafing dish having water and food pans with complemental peripheral flanges an improved heater structure comprising:

a) a spacer sized to be interposed between such flanges to maintain at least portions of such flanges in spaced relationship when such chafing dish is in use;

b) an immersible heater assembly including an upstanding arm connected to and depending from the spacer when in use;

c) the heater assembly including an encased electrical resistance heater unit, the unit being a loop having end portions connected to the arm with the arm and loop being sized to position the loop near a bottom of such water pan and immersed in water when such chafing dish is in use;

d) a temperature sensitive switch connected to the heater unit for interrupting a power supply when the temperature of the heater unit exceeds a predetermined temperature; and, e) a power supply cord extending from the spacer outwardly from such dish when the heater is in use.

2. The heater structure of claim 1, wherein the switch is a bimetalic switch.

3. The heater structure of claim 1, wherein the spacer is rectangular and sized to fit complementally between such flanges when the heater is in use.

4. The heater structure of claim 3, wherein the spacer includes four elongate elements interconnected by four corner elements with one of the corner elements connected to the depending arm.

5. A chafing dish comprising:

a) a water pan assembly including a support structure and an open topped water pan for receiving a volume of water to be heated, the water pan including a perimetral flange disposed near a top of the assembly when the assembly is in use;

b) a food pan including a perimetral flange for complemental support by the water pan when the assembly and the food pan are in use with the food pan at least partially nested within the water pan;

c) a heater structure including a spacer for interposition between the pan flanges when the dish is in use;

d) the heater structure including a resistance heater and connected leads for supplying electricity to the heater;

e) the heater structure also including a lead and heater encasement tube mechanism forming a protective water impervious housing around the leads and heater;

f) the tube mechanism including a support section depending from the spacer when in use and a heat transmitting loop section projecting from the support section and encasing at least a majority of the heater, the loop section being for positioning in water near a bottom of the water pan when in use; and, g) a heat sensitive switch housed within the mechanism and operably connected to the heater for interrupting a supply of electricity to the heater when the switch senses a temperature above a predetermined maximum.

6. The dish of claim 5, wherein the spacer is an endless member sized to be interposed between the pan flanges and perimetral of the food pan when the dish is in use.

7. For use with a chafing dish including an open topped water pan for receiving a volume of water to be heated, the water pan including a perimetral flange disposed near a top of the water pan when in use and a food pan including a perimetral flange for complemental support by the water pan when the pans are in use with the food pan at least partially nested within the water pan; the improved heater structure comprising:

a) a spacer for interposition between the pan flanges when the dish is in use;

b) the heater structure including a resistance heater element and connected leads for supplying electricity to the heater;

c) the heater structure also including a lead and heater encasement tube mechanism forming a protective water impervious housing around the leads and heater element;

d) the tube mechanism including a support section depending from the spacer when in use and a heat transmitting loop section projecting from the support section and encasing at least a majority of the heater element, the loop section being for positioning in water near a bottom of the water pan when in use; and, e) a heat sensitive switch housed within the mechanism and operably connected to the heater element for interrupting a supply of electricity to the heater element when the switch senses a temperature above a predetermined maximum.

8. The structure of claim 7, wherein the spacer is an endless member sized to be interposed between the pan flanges and perimetral of the food pan when the dish is in use.

* * * * *